US010016988B2

(12) United States Patent
Pervan

(10) Patent No.: US 10,016,988 B2
(45) Date of Patent: Jul. 10, 2018

(54) DIGITAL BINDER PRINTING

(71) Applicant: CERALOC INNOVATION AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 15/251,330

(22) Filed: Aug. 30, 2016

(65) Prior Publication Data

US 2016/0368280 A1 Dec. 22, 2016

Related U.S. Application Data

(63) Continuation of application No. 13/940,572, filed on Jul. 12, 2013, now Pat. No. 9,446,602.

(60) Provisional application No. 61/675,971, filed on Jul. 26, 2012.

(51) Int. Cl.

| | |
|---|---|
| ***B41J 11/00*** | (2006.01) |
| ***B41J 2/485*** | (2006.01) |
| ***B41J 3/407*** | (2006.01) |
| ***B41M 3/06*** | (2006.01) |
| ***B41M 5/00*** | (2006.01) |
| ***B41M 7/00*** | (2006.01) |

(52) U.S. Cl.

CPC ..... *B41J 11/002* (2013.01); *B41J 2/485* (2013.01); *B41J 3/407* (2013.01); *B41M 3/06* (2013.01); *B41M 5/0047* (2013.01); *B41M 5/0052* (2013.01); *B41M 5/0064* (2013.01); *B41M 5/0076* (2013.01); *B41M 7/009* (2013.01); *B41M 7/0081* (2013.01)

(58) Field of Classification Search

CPC ..... B41M 5/0023; B41M 5/0041; B41M 5/0082; B41M 5/0047; B41M 5/0052; B41M 5/007; B41M 5/0076; B41M 5/025; B44F 9/02; B05D 1/02; B05D 3/10; B05D 1/28

See application file for complete search history.

(56) References Cited

U.S. PATENT DOCUMENTS

| | | | | |
|---|---|---|---|---|
| 3,083,116 A | | 3/1963 | Berndt | |
| 3,397,496 A | * | 8/1968 | Sohns | E04B 1/54 52/284 |
| 3,440,076 A | | 4/1969 | Vaurio | |
| 3,446,184 A | | 5/1969 | Johnson | |
| 3,545,997 A | | 12/1970 | Hochberg | |

(Continued)

FOREIGN PATENT DOCUMENTS

| | | | | |
|---|---|---|---|---|
| DE | 10 2006 057 961 A1 | | 6/2008 | |
| DE | 10 2007 015 907 | * | 10/2008 | E04F 15/02 |

(Continued)

OTHER PUBLICATIONS

U.S. Appl. No. 15/216,081, Pervan et al.

(Continued)

*Primary Examiner* — Huan Tran

(74) *Attorney, Agent, or Firm* — Bachanan Ingersoll & Rooney P.C.

(57) ABSTRACT

A method and equipment to form a digital image on a surface by applying a powder layer including colour pigments on the surfaces, bonding a part of the powder and removing the non-bonded powder from the surface.

16 Claims, 6 Drawing Sheets

(56) References Cited

U.S. PATENT DOCUMENTS

| | | | | |
|---|---|---|---|---|
| 3,634,975 | A | 1/1972 | Hensley | |
| 3,648,358 | A | 3/1972 | Cannady et al. | |
| 3,880,687 | A | 4/1975 | Elmendorf et al. | |
| 4,227,200 | A | 10/1980 | Mansukhani | |
| 4,312,268 | A | 1/1982 | King et al. | |
| 4,467,007 | A | 8/1984 | Elgie | |
| 4,504,523 | A | 3/1985 | Miller et al. | |
| 4,689,259 | A | 8/1987 | Miller et al. | |
| 4,796,402 | A | 1/1989 | Pajala | |
| 4,833,530 | A | 5/1989 | Kohashi | |
| 4,880,689 | A | 11/1989 | Park et al. | |
| 4,943,816 | A | 7/1990 | Sporer | |
| 5,204,055 | A | 4/1993 | Sachs | |
| 5,380,392 | A | 1/1995 | Imamura et al. | |
| 5,498,466 | A | 3/1996 | Navarro | |
| 5,594,484 | A | 1/1997 | Furukawa | |
| 5,627,578 | A | 5/1997 | Weintraub | |
| 5,718,753 | A | 2/1998 | Suzuki et al. | |
| 5,778,789 | A | 7/1998 | Krishnan et al. | |
| 6,387,457 | B1 | 5/2002 | Jiang et al. | |
| 6,394,595 | B1 | 5/2002 | Jiang et al. | |
| 6,402,317 | B2 | 6/2002 | Yanagawa et al. | |
| 6,422,696 | B1 | 7/2002 | Takahashi et al. | |
| 6,439,713 | B1 | 8/2002 | Noguchi et al. | |
| 6,579,616 | B1 | 6/2003 | Beckman | |
| 6,773,799 | B1 | 8/2004 | Persson et al. | |
| 7,383,768 | B2 | 6/2008 | Reichwein et al. | |
| 7,632,561 | B2 | 12/2009 | Thiers | |
| 7,908,815 | B2 * | 3/2011 | Pervan | E04F 15/02 428/50 |
| 8,114,513 | B2 | 2/2012 | Rentschler | |
| 8,337,947 | B2 | 12/2012 | Camorani | |
| 8,353,140 | B2 * | 1/2013 | Pervan | E04F 15/02 52/578 |
| 8,371,456 | B2 | 2/2013 | Scadden | |
| 8,464,489 | B2 * | 6/2013 | Pervan | B44C 1/28 52/589.1 |
| 8,544,230 | B2 * | 10/2013 | Pervan | E04F 15/04 428/50 |
| 9,079,212 | B2 | 7/2015 | Pervan et al. | |
| 9,279,058 | B2 | 3/2016 | Pervan et al. | |
| 9,321,925 | B2 | 4/2016 | Pervan et al. | |
| 9,371,456 | B2 | 6/2016 | Pervan et al. | |
| 9,446,602 | B2 * | 9/2016 | Pervan | B41J 2/485 |
| 9,528,011 | B2 | 12/2016 | Pervan et al. | |
| 9,630,404 | B2 | 4/2017 | Pervan et al. | |
| 9,670,371 | B2 | 6/2017 | Pervan et al. | |
| 9,873,803 | B2 | 1/2018 | Pervan et al. | |
| 2001/0005542 | A1 | 6/2001 | Graab et al. | |
| 2001/0022607 | A1 | 9/2001 | Takahashi et al. | |
| 2002/0149137 | A1 | 10/2002 | Jang et al. | |
| 2003/0108718 | A1 | 6/2003 | Simon et al. | |
| 2003/0138618 | A1 | 7/2003 | Courtoy | |
| 2003/0173695 | A1 | 9/2003 | Monkhouse | |
| 2003/0207083 | A1 | 11/2003 | Hansson | |
| 2004/0101619 | A1 | 5/2004 | Camorani | |
| 2004/0142107 | A1 | 7/2004 | Eriksson et al. | |
| 2004/0153204 | A1 | 8/2004 | Blanco | |
| 2004/0177788 | A1 | 9/2004 | Rick et al. | |
| 2004/0180181 | A1 | 9/2004 | Franzoi et al. | |
| 2004/0180980 | A1 | 9/2004 | Petter et al. | |
| 2004/0217186 | A1 | 11/2004 | Sachs | |
| 2005/0093194 | A1 | 5/2005 | Oriakhi | |
| 2005/0128274 | A1 | 6/2005 | Matsushima et al. | |
| 2005/0176321 | A1 | 8/2005 | Crette et al. | |
| 2005/0249923 | A1 | 11/2005 | Reichwein et al. | |
| 2006/0144004 | A1 | 7/2006 | Nollet | |
| 2006/0188670 | A1 | 8/2006 | Kojima | |
| 2006/0246266 | A1 | 11/2006 | Hall | |
| 2007/0049047 | A1 | 3/2007 | Fujimoto | |
| 2007/0091160 | A1 | 4/2007 | Kis | |
| 2007/0107344 | A1 | 5/2007 | Kornfalt et al. | |
| 2007/0193174 | A1 | 8/2007 | Vogel et al. | |
| 2007/0224438 | A1 | 9/2007 | Van Benthem et al. | |
| 2007/0240585 | A1 | 10/2007 | Vaish et al. | |
| 2007/0283648 | A1 | 12/2007 | Chen | |
| 2007/0299196 | A1 | 12/2007 | Ohkoshi et al. | |
| 2008/0010924 | A1 | 1/2008 | Pietruczynik et al. | |
| 2008/0098659 | A1 | 5/2008 | Sung | |
| 2008/0185092 | A1 | 8/2008 | Blenkhorn | |
| 2008/0241472 | A1 | 10/2008 | Shiao et al. | |
| 2008/0261003 | A1 | 10/2008 | Lewis et al. | |
| 2009/0010682 | A1 | 1/2009 | Camorani | |
| 2009/0031662 | A1 | 2/2009 | Chen et al. | |
| 2009/0047480 | A1 | 2/2009 | Juers et al. | |
| 2009/0116966 | A1 | 5/2009 | Althoff et al. | |
| 2009/0151866 | A1 | 6/2009 | Endert | |
| 2009/0155612 | A1 | 6/2009 | Pervan et al. | |
| 2009/0252925 | A1 | 10/2009 | Provoost | |
| 2010/0046010 | A1 | 2/2010 | Bauer | |
| 2010/0134895 | A1 | 6/2010 | Hoffman et al. | |
| 2010/0166997 | A1 | 7/2010 | Chisaka et al. | |
| 2010/0192793 | A1 | 8/2010 | Verhaeghe | |
| 2010/0196678 | A1 | 8/2010 | Vermeulen | |
| 2010/0300020 | A1 | 12/2010 | Vermeulen | |
| 2010/0300030 | A1 | 12/2010 | Pervan et al. | |
| 2010/0307677 | A1 | 12/2010 | Buhlmann | |
| 2011/0024938 | A1 | 2/2011 | Tripp et al. | |
| 2011/0038826 | A1 | 2/2011 | Kimball et al. | |
| 2011/0129640 | A1 | 6/2011 | Beall | |
| 2011/0171412 | A1 | 7/2011 | Döhring | |
| 2011/0189448 | A1 | 8/2011 | Lindgren et al. | |
| 2011/0189471 | A1 | 8/2011 | Ziegler et al. | |
| 2011/0237739 | A1 | 9/2011 | Tada | |
| 2011/0247748 | A1 | 10/2011 | Pervan et al. | |
| 2011/0250404 | A1 | 10/2011 | Pervan et al. | |
| 2011/0261464 | A1 | 10/2011 | Hoffman et al. | |
| 2011/0268937 | A1 | 11/2011 | Schacht et al. | |
| 2011/0293906 | A1 | 12/2011 | Jacobsson | |
| 2012/0176443 | A1 | 7/2012 | Robertson et al. | |
| 2012/0196081 | A1 | 8/2012 | Gleich | |
| 2012/0263878 | A1 | 10/2012 | Ziegler et al. | |
| 2012/0264853 | A1 | 10/2012 | Ziegler et al. | |
| 2012/0269983 | A1 | 10/2012 | Grinberg | |
| 2013/0043211 | A1 | 2/2013 | Vermeulen | |
| 2013/0108873 | A1 | 5/2013 | Shiao et al. | |
| 2014/0017452 | A1 | 1/2014 | Pervan et al. | |
| 2014/0023832 | A1 | 1/2014 | Pervan et al. | |
| 2014/0028772 | A1 | 1/2014 | Pervan | |
| 2014/0196618 | A1 | 7/2014 | Pervan et al. | |
| 2014/0198168 | A1 | 7/2014 | Pervan et al. | |
| 2014/0198170 | A1 | 7/2014 | Pervan et al. | |
| 2014/0199495 | A1 | 7/2014 | Pervan et al. | |
| 2014/0199513 | A1 | 7/2014 | Pervan et al. | |
| 2014/0199531 | A1 | 7/2014 | Pervan et al. | |
| 2014/0220318 | A1 | 8/2014 | Pervan | |
| 2015/0030817 | A1 | 1/2015 | Wiegelmann | |
| 2015/0274997 | A1 | 10/2015 | Pervan et al. | |
| 2015/0298492 | A1 | 10/2015 | Palumbo | |
| 2016/0144612 | A1 | 5/2016 | Pervan et al. | |
| 2016/0208116 | A1 | 7/2016 | Pervan et al. | |
| 2016/0250853 | A1 | 9/2016 | Pervan et al. | |
| 2016/0325559 | A1 | 11/2016 | Pervan et al. | |
| 2017/0066255 | A1 | 3/2017 | Pervan | |
| 2017/0204281 | A1 | 7/2017 | Pervan | |
| 2017/0232761 | A1 | 8/2017 | Pervan | |

FOREIGN PATENT DOCUMENTS

| | | | |
|---|---|---|---|
| DE | 10 2010 036 454 | A1 | 1/2012 |
| EP | 0 403 264 | A2 | 12/1990 |
| EP | 0 657 309 | A1 | 6/1995 |
| EP | 0 768 535 | A2 | 4/1997 |
| EP | 0 769 535 | A3 | 9/1997 |
| EP | 1 020 303 | A1 | 7/2000 |
| EP | 1 020 765 | A1 | 7/2000 |
| EP | 1 209 199 | A1 | 5/2002 |
| EP | 1 460 108 | A1 | 9/2004 |
| EP | 1 584 378 | A1 | 10/2005 |
| EP | 1 961 556 | A1 | 8/2008 |
| EP | 2 106 903 | A1 | 10/2009 |
| EP | 2 108 524 | A1 | 10/2009 |
| EP | 2 213 476 | A1 | 8/2010 |
| EP | 2 363 299 | A1 | 9/2011 |

(56) References Cited

FOREIGN PATENT DOCUMENTS

| | | | |
|---|---|---|---|
| EP | 1 460 108 | B1 | 10/2012 |
| GB | 1 215 551 | A | 12/1970 |
| GB | 1 344 197 | A | 1/1974 |
| GB | 2 065 556 | A | 7/1981 |
| GB | 2 128 898 | A | 5/1984 |
| GB | 2 419 110 | A | 4/2006 |
| GB | 2 452 545 | A | 3/2009 |
| JP | S51-128409 | A | 11/1976 |
| JP | H05-320541 | A | 12/1993 |
| JP | H06-183128 | A | 7/1994 |
| JP | 6-287467 | A | 10/1994 |
| JP | H10-095165 | A | 4/1998 |
| JP | 2000-156796 | A | 6/2000 |
| JP | 2001-311254 | A | 11/2001 |
| JP | 2005-097339 | A | 4/2005 |
| JP | 2006-036559 | A | 2/2006 |
| JP | WO 2008/067933 | A1 | 6/2008 |
| JP | 2008-156573 | A | 7/2008 |
| JP | 2008-265229 | A | 11/2008 |
| JP | 2009-173003 | A | 8/2009 |
| JP | 2010-209325 | A | 9/2010 |
| JP | 2011-522138 | A | 7/2011 |
| KR | 2009-0112326 | A | 10/2009 |
| WO | WO 01/72489 | A2 | 10/2001 |
| WO | WO 02/42373 | A1 | 5/2002 |
| WO | WO 03/057488 | A1 | 7/2003 |
| WO | WO 2005/097874 | A2 | 10/2005 |
| WO | WO 2005/120847 | A1 | 12/2005 |
| WO | WO 2006/057241 | A1 | 6/2006 |
| WO | WO 2006/125036 | A2 | 11/2006 |
| WO | WO 2007/033031 | A2 | 3/2007 |
| WO | WO 2007/060298 | A1 | 5/2007 |
| WO | WO 2007/096746 | A2 | 8/2007 |
| WO | WO 2007/109763 | A2 | 9/2007 |
| WO | WO 2007/109763 | A3 | 9/2007 |
| WO | WO 2007/125098 | A1 | 11/2007 |
| WO | WO 2008/042088 | A1 | 4/2008 |
| WO | WO 2008/121749 | A1 | 10/2008 |
| WO | WO 2009/030935 | A2 | 3/2009 |
| WO | WO 2009/065769 | A2 | 5/2009 |
| WO | WO 2009/065769 | A3 | 5/2009 |
| WO | WO 2009/080772 | A1 | 7/2009 |
| WO | WO 2010/070485 | A2 | 6/2010 |
| WO | WO 2011/064075 | A2 | 6/2011 |
| WO | WO 2011/077200 | A1 | 6/2011 |
| WO | WO 2011/107610 | A1 | 9/2011 |
| WO | WO 2011/129757 | A1 | 10/2011 |
| WO | WO 2012/007230 | A1 | 1/2012 |
| WO | WO 2012/141651 | A1 | 10/2012 |
| WO | WO 2014/014400 | A1 | 1/2014 |
| WO | WO 2014/17972 | A1 | 1/2014 |
| WO | WO 2014/037823 | A1 | 3/2014 |
| WO | WO 2014/109703 | A1 | 7/2014 |

OTHER PUBLICATIONS

International Search Report issued in PCT/SE2013/050898, dated Oct. 24, 2013, Patent-och registreringsverket, Stockholm, SE, 6 pages.

Pervan, Darko, et al., Technical Disclosure entitled Digital Printing and Embossing, IP.com No. IPCOM000224950D, IP.com PriorArtDatabase, Jan. 15, 2013, 89 pages.

Pervan, Darko, Technical Disclosure entitled "Digital Overlay," IP.com No. IPCOM000225271D, IP.com PriorArtDatabase, Feb. 5, 2013, 24 pages.

Hudd, "Chapter 1: Inkjet Printing Technologies," *Chemistry of Inkjet Inks*, 2010, pp. 3-18, World Scientific Publishing Co. PTE. Ltd. , Published in Singapore and Hackensack, NJ.

Owens, James C., "A Tutorial on Printing", Imaging.org-Resources, 2010, pp. 1-5, Society for Imaging sciences and Technology, retrieved Jul. 27, 2015 from http://web.archive.org/web/20100706153535/http://www.imaging.org/ist/resources/tutorial.

"Digital," Definition by Merriam-Webster, 2015, pp. 1-5, Merriam-Webster, Incorporated retrieved Aug. 6, 2015, from http://ww.merriam-webster.com/dictionary/digital.

Odian, George, "Principles of Polymerization," 1991, 3rd Edition, 5 pages incl. pp. 122-123, John Wiley & Sons, Inc. New York, NY, USA.

Pervan, Darko, et al., U.S. Appl. No. 15/216,081 entitled "Digital Embossed in Register Surface," filed Jul. 21, 2016.

Pervan, Darko, U.S. Appl. No. 15/354,338 entitled "Digital Binder and Powder Print," filed Nov. 17, 2016.

Extended European Search Report dated Jan. 7, 2016 in EP 13 82 2415.9, European Patent Office, Munich, DE, 10 pages.

Romano, Frank J., Digital Printing Pocket Primer Series "Mastering On-Demand and Variable Data Printing for Profit," Copyright 2000, 52 pages, Windsor Professional Information, L.L.C., San Diego, CA.

Sandpaper Definition, Wikipedia, the free encyclopedia, retrieved from the Internet: https://en.wikipedia.org/wiki/Sandpaper, Jan. 24, 2017, 8 pages.

Pervan, Darko, et al., U.S. Appl. No. 15/478,581, entitled "Dry Ink for Digital Printing", filed Apr. 4, 2017.

Pervan, Darko, et al., U.S. Appl. No. 15/585,482 entitled "Digital Thermal Binder and Powder Printing," filed May 3, 2017.

Pervan, Darko, et al., U.S. Appl. No. 15/840,056 entitled "Digital Thermal Binder and Powder Printing," filed in the U.S. Patent and Trademark Office dated Dec. 18, 2017.

Pervan, Darko, et al., U.S. Appl. No. 15/845,828 entitled "Dry Ink for Digital Printing", filed in the U.S. Patent and Trademark Office dated Dec. 18, 2017.

* cited by examiner

DIGITAL BINDER PRINTING

CROSS REFERENCE TO RELATED APPLICATIONS

The present application is a continuation of U.S. application Ser. No. 13/940,572, filed on Jul. 12, 2013, which claims the benefit of U.S. Provisional Application No. 61/675,971, filed on Jul. 26, 2012. The entire contents of U.S. application Ser. No. 13/940,572 and U.S. Provisional Application No. 61/675,971 are hereby incorporated herein by reference in their entirety.

TECHNICAL FIELD

The disclosure generally relates to the field of digitally created decorative surfaces preferably building panels such as floor and wall panels. The disclosure relates to methods and equipment to produce such decorative surfaces.

FIELD OF APPLICATION

Embodiments of the present invention are particularly suitable for use in floors, which may be formed of floor panels comprising a core, a decorative layer and a transparent wear resistant structured layer above the decorative layer. The following description of technique, problems of known technology and objects and features of embodiments of the invention will therefore, as a non-restrictive example, be aimed above all at this field of application and, in particular, at floorings which are similar to conventional laminated floorings or floorings with a resilient surface layer.

It should be emphasized that embodiments of the invention may be used to produce a digital image on any surface but flat panels such as, for example, building panels in general, wall panels, ceilings, furniture components and similar that generally have large surfaces with advanced decorative patterns are preferred. The method may also be used to apply a print on any surface that may be flat, curved, structured or similar, on paper, foils, textiles, metal, wood veneer, cork, polymer material and similar surfaces.

BACKGROUND

The majority of all laminate floors are produced according to a production method generally referred to as Direct Pressed Laminated (DPL). Such laminated floors comprise a core of a 6-12 mm fibre board, a 0.2 mm thick upper decorative surface layer of laminate and a 0.1-0.2 mm thick lower balancing layer of laminate, plastic, paper or like material.

The surface layer of a laminate floor is characterized in that the decorative and wear properties are generally obtained with two separate layers of paper, one above the other. The decorative layer is generally a printed paper and the wear layer is a transparent overlay paper, which comprises small aluminium oxide particles.

The printed decorative paper and the overlay are impregnated with melamine formaldehyde resins and laminated to a HDF core in large discontinues or continuous laminate presses where the resin cures under high heat and pressure and the papers are laminated to the core material. An embossed press plate or steal belt forms the surface structure. Sometimes a structured paper is used as a press matrix.

Laminated floors may also be produced with printing technology. One advantage is that the pressing operation may be avoided and that no printed papers are needed to provide a decorative wear resistance surface.

Floor panels with a Direct Printed Laminate surface comprise the same type of HDF core as DPL. The décor is printed directly onto the core. The production process is rather complicated and is only cost efficient in very large production volumes. Hydro printing inks are used to print the décor by a multicolour printing press with rollers that print directly onto the pre-sealed core.

Direct printing technology may be replaced with Digital Printing Technology that is much more flexible and small production volumes can be economically manufactured. The difference between these two methods is mainly the printing step where printing rollers are replaced by a digital non-contact printing process and where the desired image is directly applied on to the pre-finished core.

Digital printing may also be used to print on a paper sheet that is used in conventional laminate production and laminated under heat and pressure. The printing may be made prior to or after impregnation.

Paper and plastic foils are also used as surface layers in flooring and such materials may also be printed digitally.

Recently new "paper free" floor types have been developed with solid surfaces comprising a substantially homogenous powder mix of fibres, binders and wear resistant particles.

The powder mix may comprise aluminium oxide particles, melamine formaldehyde resins and wood fibres. In most applications decorative particles such as, for example, colour pigments are included in the mix. In general all these materials are applied in dry form as a mixed powder on a HDF core and cured under heat and pressure to a 0.1-1.0 mm solid layer. The powder is prior to pressing stabilized with moisture and UV lamps such that it forms an upper skin layer similar to a paper layer and this prevents the powder from blowing away during pressing. Melamine formaldehyde resin and wood fibres may be replaced by thermoplastic particles.

Several advantages over known technology and especially over conventional laminate floorings may be obtained such as increased wear and impact resistance, deep embossing, increased production flexibility and lower costs.

Powder technology is very suitable to produce a decorative surface layer, which is a copy of stone and ceramics. It is however more difficult to create designs such as, for example, wood decors. However, recently digital powder printing has been developed and it is possible to create very advanced designs of any type by injecting ink into the powder and create a digital print in the powder prior to pressing. The surface structure is made in the same way as for laminate flooring by a structured press plate, steal belt or an embossed matrix paper that is pressed against the powder.

Floors with a surface of wood are produced in many different ways. Traditional solid wood floors have developed into engineered floors with wood layers applied on a core made of wood lamellas, HDF or plywood. The majority of such floors are delivered as pre-finished floors with a wood surface that is coated with several transparent layers in the factory. Recently wood floorings have also been produced with a digitally printed pattern that improves the design of the wood grain structure in wood species that do not have a sufficient surface quality.

Digital printing is used in several floor types to create a décor. However the volumes are still very small mainly due to the high cost of the ink and the high investment cost for the industrial printers. It would be a major advantage if the ink cost could be reduced and if more cost efficient equipment could be used in an industrial scale.

Definition Of Some Terms

In the following text, the visible surface of the installed floor panel is called "front side", while the opposite side of the floor panel, facing the sub floor, is called "rear side". By "surface layer" are meant all layers, which give the panel its decorative properties and its wear resistance.

By "print" is meant a décor or image. By "up" is meant towards the front side and by "down" towards the rear side. By "vertically" is meant perpendicular to the surface and by "horizontally" parallel to the surface.

By "pigments" is meant a very fine powder of solid colorant particles.

By "Pigment ink" is meant an ink comprising pigments that are suspended or dispersed throughout a carrier fluid.

By "dye ink" is meant a coloured substance that is dissolved fully into the carrier fluid and the resultant ink is a true solution completely soluble like sugar in water.

By "aqueous or water based ink" is meant an ink where water is used as liquid substance in the ink. The water-based liquid carries the pigments.

By "solvent based ink" is meant ink that generally contains three major parts such as a fluid carrier, pigments and resins. Technically, solvent ink refers generally only to the oil-based carrier portion of the ink that keeps the other components in liquid form and once applied to a surface through jetting evaporates.

By "UV curable inks or coating" is meant ink or coating that after application is cured by exposure to strong UV-light in an UV oven.

By "binder" is meant a substance that connects or contributes to connect two particles or materials. A binder may be liquid, powder based, a thermosetting or thermoplastic resin and similar.

Known Technique and Problems Thereof

The general technology, which is used by the industry to provide a digital print, is described below. The methods described below may be used separately or in combinations to create a digital print or a digital application of a substance in the embodiments of this disclosure.

High definition digital printers use a non-impact printing processes. The printer has print heads that "fire" drops of ink from the print heads to the substrate in a very precise manner.

Multipass printing, also called scanning printing, is a printing method where the printer head moves transverse above the substrate many time to generate an image. Such printers are slow but one small print head can generate a bigger image.

Industrial printers are generally based on a Single Pass printing method, which uses fixed printer heads, with a width that corresponds to the width of the printed media. The printed substrate moves under the heads. Such printers have a high capacity and they are equipped with fixed print heads that are aliened one after each other in the feeding direction. Each print head prints one colour. Such printers may be custom made for each application.

FIG. 1*a* shows a single pass printer 35 comprising five digital print heads 30*a-e*, which are connected with ink pipes 32 to ink containers 31 that are filled with ink of different colours. The print heads are connected with digital data cables 33 to a digital control unit 34 that controls the application of the ink drops and the speed of the conveyor 21 that displaces the panel under the print heads with high precision in order to guarantee a high quality image comprising several colours. FIG. 1*b* shows a wood grain print P provided on a panel surface 2. The surface of a floor panel is often embossed with a standard structure 17 that is the same for several basic decors as shown in FIG. 1*c*. Advanced floors use an embossing 17 that is in register with the printed pattern P as shown in FIG. 1*d*.

A normal width of an industrial print head is about 6 cm and any lengths may be printed. Wide areas of 1-2 m may be printed with digital printers comprising several rows of print heads aligned side by side.

Number of dots per inch or DPI is used to define the resolution and the printing quality of a digital printer. 300 DPI is generally sufficient to, for example, print wood grains structures of the same quality presently used in conventional laminate floorings. Industrial printers can print patterns with a resolution of 300-600 DPI and even more and with a speed exceeding 60 m/min.

The print may be a "full print." This means that the visible printed décor is mainly created by the ink pixels applied on the surface. The colour of a powder layer or a base colour of a paper has, in such an embodiment, in general a limited effect on the visible pattern or décor.

The print may also be a "part print". The colour of another underlying layer is one of the colours that are visual in the final décor. The area covered by printed pixels and the amount of ink that is used may be reduced and cost savings may be obtained due to lower use of ink and increased printing capacity compared to a full print design. However a part print is not as flexible as a full print since the base colours are more difficult to change than when a full print is used.

The print may be based on the CMYK colour principle. This is a 4-colour setup comprising cyan, magenta, yellow and black. Mixing these together will give a colour space/gamut, which is relatively small. To increase specific colour or the total gamut spot colours may be added. A spot colour may be any colour. The colours are mixed and controlled by a combination of software and hardware (print engine/print heads).

New technology has been developed by Välinge Innovation AB that makes it possible to inject a digital print into a powder layer. This new type of "Digital Injection Print" or DIP is obtained due to the fact that printing is made into a powder that is cured after printing. The print is embedded into the cured layer and is not applied on a layer as when conventional printing methods are used. The print may be positioned in several dimensions horizontally and vertically in different depths. This may be used to create 3D effects when transparent fibres are used and to increase the wear resistance. No protective layers are needed that disturb the original design.

The DIP method may be used in all powder based materials, which may be cured after printing. However, the DIP method is especially suitable to be used when the powder comprises a mix of wood fibres, small hard wear resistant particles and a melamine formaldehyde resin. The surface layer may also comprise thermoplastic material, for example, vinyl particles, which are applied in powder form on a substrate. This allows that the print may be injected in the vinyl powder particles. An improved design and increased wear resistance may be reached even in such materials.

A suitable printer head has to be used in order to obtain a high printing quality and speed in powder based layers and other layers as described above. A printer head has several small nozzles that can shoot droplets of inks in a controlled way (Drop On Demand—DOD). The size of each droplet may vary, dependant on ink type and head type, between normally 1-100 picolitres. It is possible to design print heads that may fire bigger drops up to 200 picolitres more. Some printer heads can shoot different droplet sizes and they are able to print a greyscale. Other heads can only shoot one fixed droplet size.

Different technologies may be used to shoot the drops out of the nozzle.

Thermal printer head technology use print cartridges with a series of tiny chambers each containing a heater, all of which are constructed by photolithography. To eject a droplet from each chamber, a pulse of current is passed through the heating element causing a rapid vaporisation of the ink in the chamber to form a bubble, which causes a large pressure increase, propelling a droplet of ink out through the nozzle to the substrate. Most consumer inkjet printers, from companies including Canon, Hewlett-Packard, and Lexmark use thermal printer heads.

Most commercial and industrial inkjet printer heads and some consumer printers such as those produced by Epson, use the piezoelectric printer head technology. A piezoelectric material in an ink-filled chamber behind each nozzle is used instead of a heating element. When a voltage is applied, the piezoelectric material changes shape, which generates a pressure pulse in the fluid forcing a droplet of ink from the nozzle. Piezoelectric (also called Piezo) inkjet allows a wider variety of inks than thermal inkjet, as there is no requirement for a volatile component, and no issue with kogation. A lot of ink types may be used such as dye inks, solvent based inks, latex inks or UV curable inks.

Pigment based inks are generally individually mixed together by using colour pigments and several chemicals. A pigment is a very fine powder of solid colorant particles that are suspended or dispersed throughout a liquid carrier. Pigments used in digital ink have an average particle size of about 0.1 micron. The common size of the nozzles are about 20 microns which meant that the pigment particle have enough space to pass through the nozzle channels in the print head. The nozzles may still be blocked by the ink itself and pigments that form clusters of particles. A high quality pigment ink should keep the pigment suspended in the carrier fluid for a long period of time. This is difficult particularly at the low viscosities that are required for a good functioning of the print heads. Pigments have a natural tendency to settle out and fall down in the liquid carrier. In high quality pigment ink, no settling out of the pigment should normally occur.

Water based inks comprising colour pigments are especially suitable and may provide a high quality printing method in many different materials. Pigment inks are generally more light fast and more fade resistant than dye-based inks.

The pigments do not stick to a surface. They are similar to sand particles and may be easily removed from most dry surfaces. The water based carrier fluid is therefore generally mixed with small amounts of several other additives to provide special ink and print properties, such as binders that provide the adhesion of the pigments to a surface, dot gain, pH level, drop formation, corrosion of the print head, fade resistance etc.

Colour pigments as such are rather cost competitive but the production of pigment based inks and other inks for digital printers is very complicated and expensive and this results in a very high cost for the ink that normally may be in the region of about 100 EUR/litre. About 100 m2 of flooring may be printed with one litre if a full high quality print is applied and this gives a cost of 1 EUR/m2. The costs for a conventional printed floor surfaces where printing cylinders are used are only 10% of the cost for digitally printed floor surfaces.

Digital ink jet printers use a non-contact method to apply the ink on a surface. Laser printing however is based on a contact method where a laser beam projects an image on an electrically charged rotating drum. Dry ink particles, generally called toner, are then electrostatically picked up by the drum's charged areas. The ink comprises fine particles of dry plastic powder mixed with carbon black or colouring agents. The thermosetting plastic material acts as a binder. The drum prints the image on a paper by direct contact and heat, which fuses the ink to the paper by bonding the plastic powder to the paper. Colour laser printers use the CMYK principle with coloured dry ink, typically cyan, magenta, yellow, and black that are mixed in order to provide a high quality coloured image.

The laser technology with the impact method is not used for printing of a flat panel surfaces such as a floor panel surfaces.

The above description of various known aspects is the applicants' characterization of such, and is not an admission that any of the above description is prior art. Several of the technologies described above are known and used individually but not in all combinations and ways as described above.

As summary it may be mentioned that digital printing is a very flexible method but it cannot be fully utilized due to the high cost for the ink. The costs are primarily caused by the need to mill down the colour pigments to well-defined very small particles and to disperse the particles throughout the carrier fluid. It would be a major advantage if digital images may be created with ink that does not contain colour pigments or colour substances.

The digital application technology is only used to obtain advantages related to the possibility to create a high-resolution image in a flexible way. However, the other aspects of the technology, mainly related to the possibility to apply a liquid substance very precisely with a non-impact method, have not been fully utilized or developed.

It is known that powder applied on a liquid substance could be used to create raised portions or an image on mainly a paper substrate and that the liquid substance may be applied digitally by ink jet.

U.S. Pat. No. 3,083,116 describes raised printing powder and a raised printing process comprising dusting a powdered resin upon a newly printed sheet, removing therefrom the excess powder which do not adhere to the wet ink, and applying heat to the powder retained on the sheet to fuse it so that particles thereof will flow together and adhere to the sheet. The powder may comprise a phenolic resin.

U.S. Pat. No. 3,446,184 describes a method to form a sticky image copy. Toner powder is applied on a liquid forming and a portion of the powder is retained by the liquid coating, forming a visible image. Loose powder is removed and the sheet passes a heating unit where the retained powder is fused to form a permanent image.

U.S. Pat. No. 4,312,268 describes a method by which a water-based ink is applied digitally to a continuous web and fusible single colour powder material is applied to the web and on the ink. Some of the powder material is bonded to the liquid, and non-bonded powder material is removed from the web prior to heating of the web to dry the liquid and to fuse the powder material to the web by melting the powder.

It is mentioned that the powder material may have a particle size in the range of 5 to 1000 microns and may have a melting point or fusing point in the range of 50 to 300 degrees Centigrade. The powder material may be produced by dissolving or dispersing, respectively, a dye or a pigment in a resin or resin formulation, followed by grinding, spray chilling or the like to reduce the material to a fine powder. The powder material may provide abrasion resistant qualities to the ink that may contain phenolic resin. The liquid material, which is applied through the jets, may be clear and colourless water.

U.S. Pat. No. 6,387,457 describes a method of printing using dry pigments. A binder material is applied to a surface of a substrate uniformly or in a pattern. Dry pigment is applied to the binder material in a pattern or uniformly. The dry pigment material comprises flakes of non-metallic material having a particle size less than about 100 micron. The flakes are aligned in a direction parallel with the surface of the substrate.

EP 0 403 264 A2 describes a transfer method to form a multi-colour image on a drum that transfers the image to a paper. A fluid digital latent image is subsequently developed at a development station where coloured powder is applied to the fluent latent image and fixed to produce a visible and permanent image. Several digital print heads may be used that print with dyeless fluids comprising a mixture of water with polyhydric alcohols and their sub-sets of ethylene glycol, glycerol, diethylene glycol and polyethylene glycol. A powder toner is applied across the surface of the paper and a voltage is applied during this development. The voltage is then reversed to remove the toner from the background areas. Fixing is achieved by means of conventional copier fusing methods.

EP 0 657 309 A1 describes a multicolour transfer method utilizing a transfer paper carrying a pattern formed by ink jet and powder similar to the above described methods. The transfer method is intended for decorating ceramics.

WO 2011/107610 describes a method to create an elevation or an embossing on a floor panel in order to avoid the use of expensive press plates. The method is the same as the known methods to create a raised print. It describes a method to produce a floorboard by printing a curable substance for creating an elevation on the panel. The elevation may be applied on a basic decorative pattern that is directly printed or laminated on the panel. The curable substance may comprise wear resistant particles. The curable substance may be digitally printed on the panel by first printing a liquid in a pre-defined pattern and then providing an intermediate substance that may comprise a powder. The curable substance may be cured by UV radiation or may be a varnish.

The known methods are not suitable for creating a high quality multi-colour image on a building panel, and especially not on a floor panel where UV resistant pigments must be used and where the image must be incorporated into a wear resistant surface. It is not known that the known principles may be used to create an image on a flooring surface that is pressed and especially not how the principles should be adapted for printing of floor surfaces similar to laminate and Wood Fibre Floors (WFF) where the powder, the ink and the application methods must be adapted to the specific resins, materials and pressing parameters which are needed to form a wear, impact and stain resistant high quality multi-colour surface in a cost efficient way.

Objects and Summary

The objective of at least certain embodiments of the invention is to provide a method and equipment to produce a digitally printed building panel, preferably a floor panel, that may be produced in a more cost efficient way without ink that comprises a colour substance, for example, without colour pigments that are complicated to handle in a digital printing head.

The above objectives are exemplary, and the embodiments of the invention may accomplish different or additional embodiments.

A first aspect of the invention is a method of forming a digitally printed image with colour pigments on a surface of a building panel, comprising the steps of:

scattering dry colour pigments on the surface, bonding a part of the dry colour pigments to the surface, and removing the non-bonded dry colour pigments from the surface such that a digitally created image is formed by the bonded colour pigments.

According to a first principle of the first aspect, a pattern or image may be formed digitally by a digital coating head that only applies a binder on a surface. The pigments are scattered randomly by a second device over the pattern. The binder connects some pigments to form the same pattern as the binder while other non-bonded pigments are removed.

This two-step process, where the pigments and a liquid binder are applied separately, may provide an image with a comparable quality as conventional digital printing technology, for example comparable to at least 300 DPI.

According to a second principle of the first aspect, the pigments may be scattered on a surface in a first step and a digital coating head that only applies a binder on the scattered mix thereafter forms a pattern or image digitally. The digitally applied binder may comprise water that melts, for example, melamine formaldehyde particles that may be substantially homogenously mixed with pigments. The binder connects some pigments that form the same pattern as the binder while other non-bonded pigments are removed.

According to a third principle of the first aspect, the pigments may be scattered on a surface in a first step and a binder pattern or image is thereafter formed digitally by a laser beam that bonds some pigments to the surface by melting or curing a binder that may be mixed with the pigments or included in the surface under the pigments. A digitally created print is obtained when the non-bonded pigments are removed.

The dry colour pigments may be bonded to a binder on the surface of the building panel.

The dry colour pigments may be mixed with a binder.

The binder may be a dry powder or a liquid substance.

The binder may comprise a thermosetting or a thermoplastic resin.

The surface of the building panel may comprise a thermosetting resin, preferably melamine formaldehyde resin.

The surface may be a paper layer, a foil, a wood or wood-based layer, or a powder layer. The powder layer may comprise a mix comprising lignocellulosic or cellulosic particles, a binder and optionally wear resistant particles, for example, aluminium oxide. The binder is preferably a thermosetting binder such as melamine formaldehyde resin.

The building panel may have a surface of a resin impregnated paper, thermoplastic film or foil, a powder layer comprising lignocellulosic or cellulosic particles and a binder. The building panel may be formed by applying heat and pressure.

The building panel may be a floor panel. The surface may be a part of a floor panel.

The floor panel may comprise a mechanical locking system for vertical and horizontal locking.

The building panel may be a wall panel or a furniture component. The surface may be a part of a wall panel or a furniture component.

The pigments may be removed by an airstream.

The step of bonding said part of the dry colour pigments to the surface may comprise applying a liquid substance by a digital coating head. The liquid substance may be applied on the surface before the dry colour pigments are applied on the surface, or may be applied on the surface after the dry colour pigments have been applied on the surface.

The liquid substance may be water based.

The liquid substance may be exposed to UV light.

The liquid substance may be water based UV curable polyurethane.

The liquid substance may comprise a binder such as a thermosetting or a thermoplastic binder.

The liquid substance may be applied with a Piezo ink head.

The step of bonding said part of the dry colour pigments to the surface may comprise applying a laser beam to bond the dry colour pigments to the surface.

The method may further comprise applying heat and pressure to the surface of the building panel. The surface of the building panel may be pressed after the digitally created image has been formed by the bonded colour pigments. Final bonding of the dry colour pigments to the surface of the building panel may occur by applying heat and pressure to the surface of the building panel. For example, the binder bonding the dry colour pigments to the surface of the building panel may be cured by applying heat and pressure to the surface of the building panel. The binder, for example a thermosetting resin such as melamine formaldehyde resin, bonding the dry colour pigments to the surface of the building panel may be cured simultaneously as the binder, for example a thermosetting resin such as melamine formaldehyde resin, of the surface of the building panel. The curing may occur my applying heat and pressure to the surface of the building panel.

The second aspect of the invention is to provide equipment to form a digital image on a building panel, wherein the equipment comprises a digital coating head, a powder scattering unit, and a powder removal system. The digital coating head is configured to apply a liquid substance on a surface of the building panel or on a layer of powder comprising pigments and/or binder on a surface of the building panel. The powder scattering unit is configured to apply a powder layer comprising colour pigments on the surface of the building panel. The liquid substance is configured to bond a part of the powder to the surface of the building panel, and the powder removal unit is configured to remove the non-bonded powder from the surface of the building panel. A digital image is thereby formed by the bonded colour pigments.

The powder may comprise a thermosetting resin.

The liquid substance may be water based. The liquid substance may be exposed to UV light. A surface of the building panel comprises a thermosetting resin, preferably melamine formaldehyde resin.

The equipment may further comprise a pressing unit adapted to apply heat and pressure to the surface of the building panel. The surface of the building panel may be pressed after the digital image has been formed by the bonded colour pigments.

The production method and equipment according to embodiments of the invention make it possible to produce very advanced decorative patterns in a flexible and very cost efficient way since the digital equipment is only used to create a pattern with a binder that does not have any colour pigments.

Embodiments and details of various aspects may be combined with embodiments and detailed of the other aspects. Mixing colour pigments in the liquid binder is not excluded and this may be used to, for example, apply smaller amounts of pigments with the digital coating head that may be needed for a specific colour combination.

BRIEF DESCRIPTION OF THE DRAWINGS

The invention will in the following be described in connection to exemplary embodiments and in greater detail with reference to the appended exemplary drawings, wherein.

DETAILED DESCRIPTION OF EMBODIMENTS

FIGS. 2*a*-2*d* show an embodiment of the invention, which is based on a first principle where a binder pattern BP or image is formed digitally by a digital coating head that applies a binder 11 in the form of a liquid substance. A digital print head or digital ink head that is mainly used to apply a liquid substance without any colorants, and which is not intended to print a coloured image is hereafter referred to as a "digital coating head". Pigments 12 are scattered randomly by a second device over the binder pattern BP. The binder connects some pigments to form the same pattern as the binder while other non-bonded pigments are removed.

This two-step process, where the pigments and a liquid binder are applied separately, may provide an image with the same quality as conventional digital printing technology. The method is particularly suitable in applications where considerable quantities of pigments have to be applied on a large flat panel 1 in order to form an advanced large image or decorative pattern. Contrary to known methods, the digital coating head, is typically not used to apply any type of conventional ink with colour pigments. This is a major advantage since no expensive inks comprising pigment dispersions have to be handled by the digital coating head.

Figure 1A:
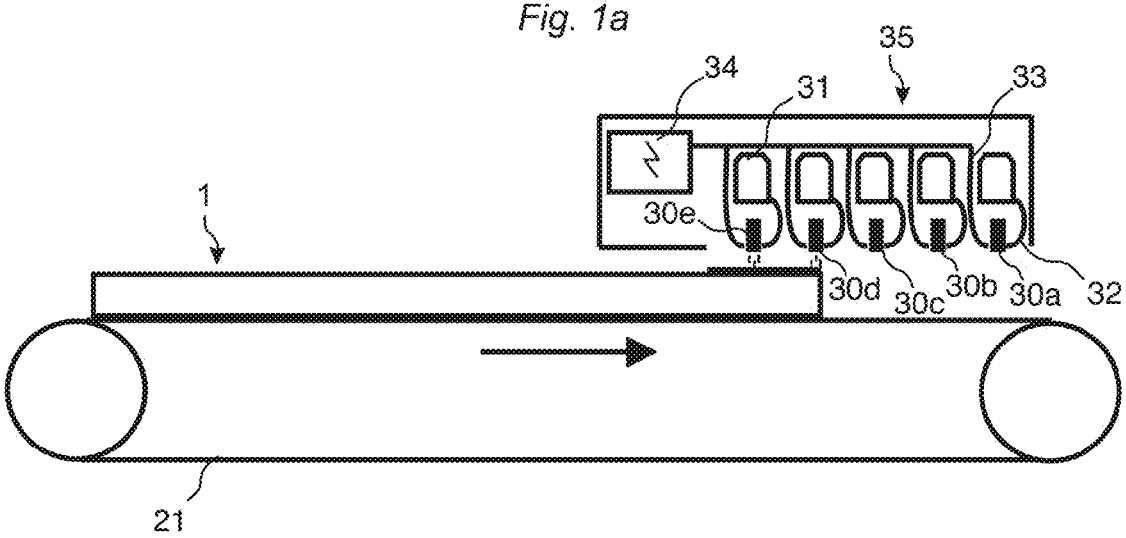
FIGS. 1*a-d* illustrate know methods to produce a printed and embossed surface.
Figure 1B:
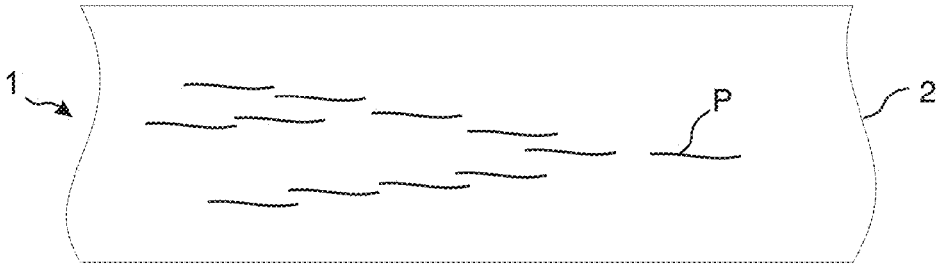
Figure 1C:
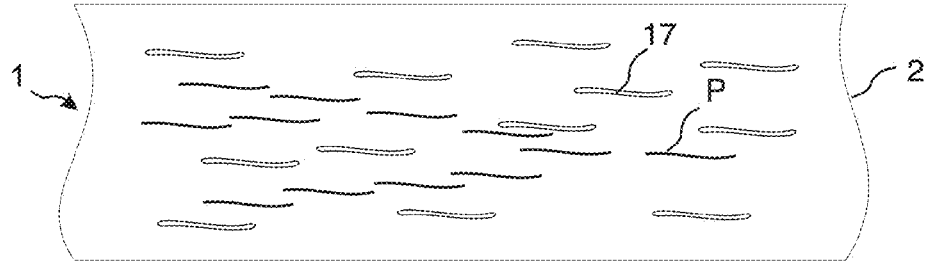
Figure 1D:
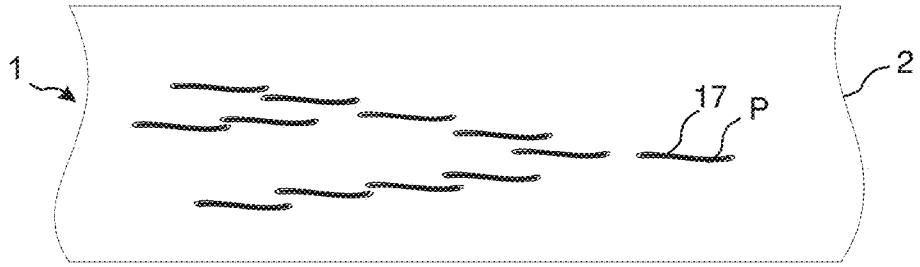
Figure 2A:
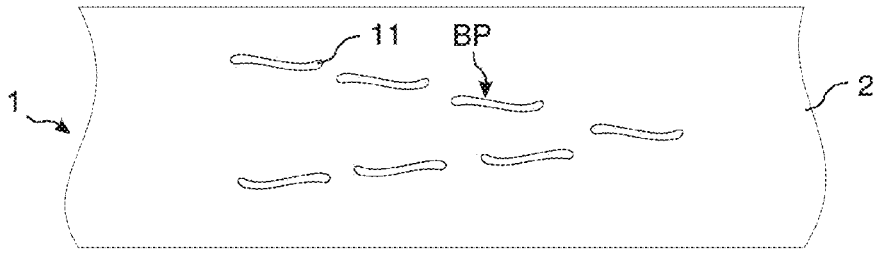
FIGS. 2*a-d* illustrate a first aspect of the invention.
Figure 2B:
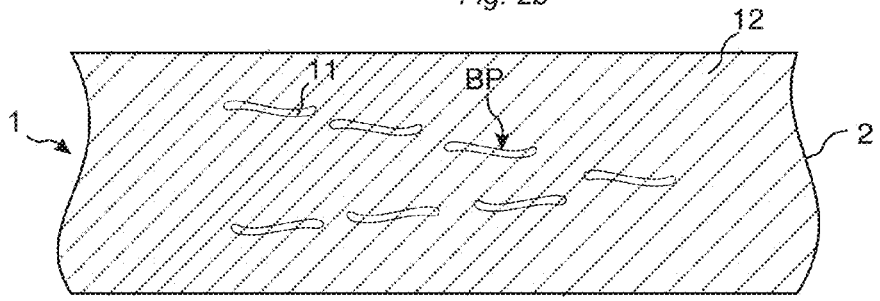
Figure 2C:
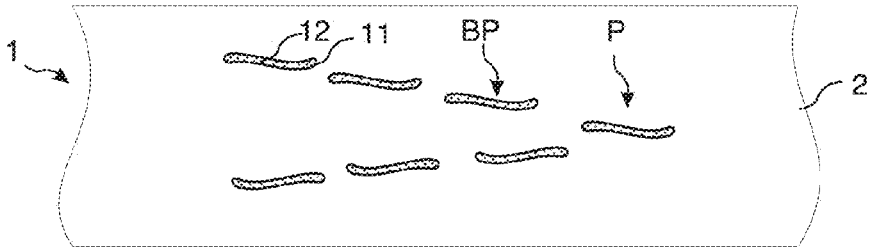
Figure 2D:
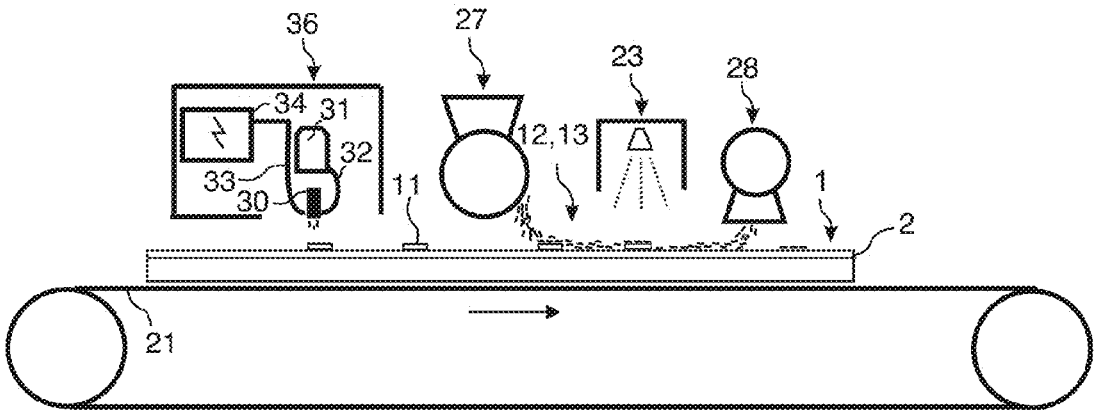

FIG. 2*a* shows that a binder pattern BP is formed on a surface 2 of a building panel 1 by a digital coating head 30 as shown in FIG. 2*d*. The surface 2 may, for example, be a paper layer, a stabilized powder layer, a foil or a base colour applied on a material, preferably a wood or plastic based core material. The binder 11 is in this preferred embodiment water based and comprises preferably mainly water, such as at least 50% water. The binder 11 may further comprise additives such as release agents, surface tension agents, wetting agents, viscosity increasing agents, etc. A pigment layer 12 is applied, for example, by scattering as dry powder over the wet binder pattern BP as shown in FIG. 2*b*. The pigment layer may comprise, for example, melamine formaldehyde powder particles that melt when they are in contact with the water-based pattern BP. The dry pigments and melamine formaldehyde powder that do not contact the water-based pattern BP are removed by, for example, an air stream and the remaining colour pigments 12 form a print P as shown in FIG. 2*c*, which is essentially identical to the binder pattern BP.

The print P may be dried and stabilized by, for example, exposure to IR or UV lights that heat up the wet melamine formaldehyde resin and bond the colour pigments to the surface 2 by drying the wet melamine formaldehyde resin. A second bonded pattern may be coated on the surface 2 and a second layer of pigments and melamine formaldehyde powder may be applied on the surface and over and/or adjacent to the first print. An advanced décor may be created with several colours.

The binder in this embodiment may comprise wet melamine formaldehyde and may be applied in two steps, first as a liquid substance, such as water, from the digital coating head 30, and second as powder from a scattering unit 27. The powder may be mixed with the dry colour pigments. This simplifies the function of the digital coating head that only has to apply water drops without any, or with limited amounts of, binders and colour pigments.

The binder may be included in dry form in the powder and activated by the liquid substance applied by the coating head as described above or it may only be included in the liquid substance applied by the digital coating head.

This method wherein the liquid substance and the powder are applied directly on a panel is suitable to form a digital image on a building panel. A method comprising the following steps is especially suitable for forming an image on a floor surface having high impact and wear resistance. A liquid substance compatible with thermosetting resins is applied and the substance must have specific chemical properties such that no defects are caused during curing of the thermosetting resins. This may be accomplished with a liquid substance that for example comprises water and/or glycols. The substance should be applied on a surface of a building panel in order to eliminate problems related to positioning of the print on the panel. Thermosetting resins such a melamine formaldehyde resins are preferably included in a surface layer of a panel and/or in the powder applied on the panel and they may react with the liquid substance and bond the powder to the panel surface such that non-bonded powder may be removed. The powder comprises preferably UV stable colour pigments.

The advantages are that such combination of materials may be pressed and cured with high pressure, exceeding 40 bars, and heated to a temperature exceeding 160 degrees Celsius. The surface and the digitally formed image may be cured to a hard wear resistant surface without so called bleeding of the pigments during the pressing and heating step and the pigments may be incorporated into the cured surface such that they may create a UV stable wear resistant image similar to the images of conventional laminate floors.

A wide variety of thermosetting and thermoplastic materials may be used as particles in the scattered powder or as dispersions or liquid substances in the binder applied by the digital coating head. The majority of such materials may be produced in dry powder form or as liquid dispersions.

As an alternative to thermosetting materials, such as melamine formaldehyde, or to thermoplastic materials, such as, for example, PVC powder, UV curable polyurethane may, for example, be used in powder form or as dispersion.

UV curable polyurethane substance with a viscosity that is adapted to the digital coating head 30 may be used. Water-based polyurethane dispersions are preferred as a liquid substance in the digital coating head since they do not cure until they are exposed to UV light. Polyurethane dispersions are fully reacted polyurethane/polyureas of small and discrete polymer particles and such particles may be produced with a size of about 0.01-5.0 microns and may therefore be handled in a digital print head or other similar heads. They may have 20-70% solid content. Polyurethane dispersions may be blended with, for example, acrylic emulsions and other emulsions in order to reduce costs.

The digital coating head 30 that preferably is a Piezo head has preferably a capacity to fire drops with a drop size of about 1-200 picolitres or more. The drop size may be varied and this may be used to vary the intensity of a colour and to create a grey scale with the same basic colour.

Water based adhesives may also be used such as soluble adhesives or water dispersed adhesives.

Other UV curable materials such as acrylates of epoxy, urethane, polyester, polyether, amine modified polyether acrylic and miscellaneous acrylate oligomers may be used in powder for or as dispersions.

FIG. 2*d* shows one "binder printing" station of a binder printing equipment that may be used to create a digital print with the digital "binder print" method. A digital coating head 30, that may be a Piezo head, applies a binder pattern BP. Several coating heads 30 may be positioned side by side in order to cover the width of the surface that is printed. The binder pattern is created digitally in the same way as in conventional digital printing. The colours are separated and each coating unit 36 applies mainly the same substance that is used to bond one specific colour in each coating step. The digital coating head is connected with a feeding pipe 32 to a container 31 that comprises a binder or a one component of a binder, preferably a water based substance, which in this embodiment may be mainly distilled or deionized water. The digital coating heads are connected with digital data cables 33 to a digital control unit 34 that controls the application of the drops, the speed of the conveyor 21, the function of a powder application unit and all other equipment that is used to bond and remove pigments.

The water drops that serve as a binder 11 should be wet until they pass a scattering station 27 that applies a powder mix that in this preferred embodiment comprises colour pigments 12 and melamine formaldehyde powder 13. The melamine formaldehyde particles in the powder mix that are in contact with the wet water based binder pattern BP melts and the water/melamine formaldehyde solution acts as a binder that connects a part of the pigment/melamine formaldehyde mix to the surface 2 of the panel 1. When the powder mix is displaced under a preferably hot UV curing oven 23 with ultra violet light, which is located preferably after the digital coating unit 36 in the feeding direction, a practically instant bonding or curing within a few seconds may take place.

A powder removal system 28 that in this embodiment is based on an air stream and vacuum removes pigments and melamine formaldehyde particles that are not bonded by the binder pattern BP and a perfect colour print P is provided. This production step may be repeated and another colour may be applied by a second scattering unit 27 that comprises another colour. The removed dried pigments and melamine formaldehyde particles may pass through a sieve or a filter and they may be recycled and reused again several times.

Melamine formaldehyde or other binders may also be included in the surface layer 2 as a dry layer when, for example, a melamine formaldehyde impregnated paper layer or a stabilized powder layer is used as a basic surface. The water based bonding pattern will melt a part of this melamine formaldehyde layer and only pigments may be applied as powder by the scattering unit 27 and recycled.

This method may also be used when a complete binder substance is included in the liquid substance applied by the digital coating head.

The powder mix may, in addition to pigments and melamine formaldehyde particles, also comprise wear resistant particles such as small aluminium oxide particles and fibres, preferably wood fibres that preferably comprise bleached transparent or semi-transparent fibres. Such a mix may be used to create a solid print with pigments that are positioned vertically above each other with binders and wear resistant particles above and below the pigments. A water-based substance without any pigments may penetrate deeper into the powder mix than pigments applied as dispersion in a conventional digital printing and a very wear resistant print may be obtained.

Several layers of prints may be position above each other and this may be used to increase the wear resistance further and to create 3D decorative effects.

Static electricity may be used to apply and/or to remove the non-bonded powder particles. Airstreams and vacuum that blows away and/or sucks up particles may be combined with brushes. In general all dry and wet methods that are used to remove dust may be used separately or in various combinations to remove the pigments and the non-bonded parts of the scattered powder mix. However, dry and non-impact methods are preferred.

A controlled complete or partial removal of the non-bonded pigments is essential for a high quality print with a pre-defined decorative image. Advanced removal systems may also be used that only removes the colour pigments while the essential part of the transparent melamine formaldehyde powder particles may remain on the surface. This may be accomplished by, for example, a two-step scattering where a first layer comprises only melamine formaldehyde particles that are connected to the surface prior to the application of the binder, sprayed with water and dried with IR, hot air, UV and similar methods. This separate melamine formaldehyde layer may in some applications replace, for example, pre-impregnated paper and only non-impregnated paper with or without a base colour may be used as a surface layer 2.

The moisture content of the surface layer should be accurately controlled in order to facilitate the removal of the non-bonded powder particles. Moisture content below 6% is preferred. The surface layer 2 may be dried by, for example, IR or UV lamps or hot air prior to the application of the pigments. Water and special chemicals, such as release agents, may be applied in order to seal the surface 2 or the upper part of the bonded colour pigments in order to create a sealing or a release layer that may prevent colour pigments to stick to specific parts of the surface layer where no binder is applied.

The print may be covered with transparent protective layers of, for example, a paper based or powder based overlay comprising aluminium oxide and melamine formaldehyde resins or a UV curing coating that may be applied by rollers or digitally with, for example, Piezo coating heads.

Figure 3A:
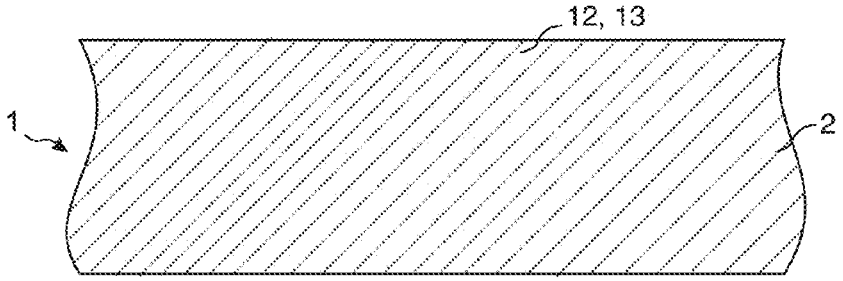
FIGS. 3*a-d* illustrate a second aspect of the invention.
Figure 3B:
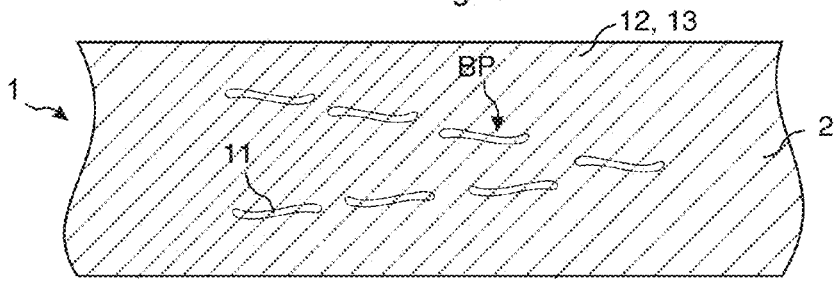
Figure 3C:
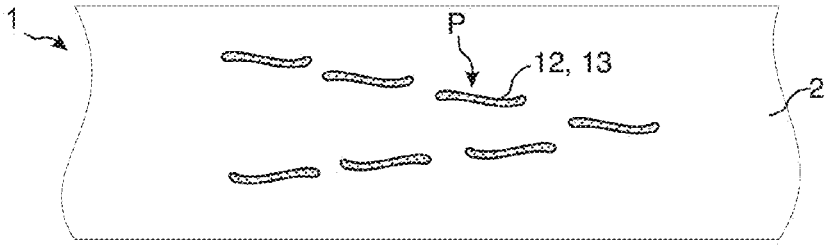
Figure 3D:
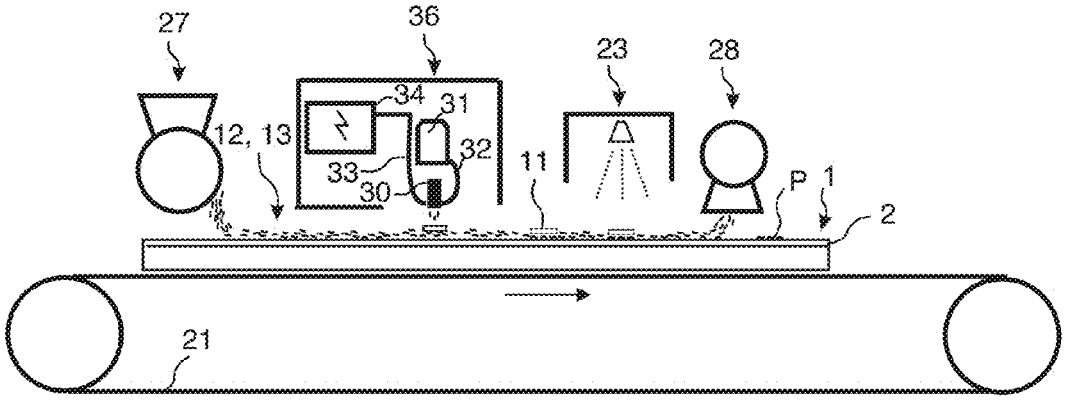

FIGS. 3*a*-3*d* show an embodiment of the invention, which is based on a second principle where the pigments 12 in a first step are scattered on a surface 2 and a pattern or image is thereafter formed digitally by a digital coating head that only applies a binder pattern BP on the scattered mix. The digitally applied binder may comprise water that melts, for example, melamine formaldehyde particles 13 mixed with pigments 12 or applied under the pigments. The binder connects some pigments to form the same pattern as the binder pattern BP while other non-bonded pigments are removed. FIG. 3*a* shows a substantially homogenous mix of melamine formaldehyde powder 13 and pigments 12 scattered on a surface 2. FIG. 3*b* shows a digitally applied binder pattern BP applied on the mix. FIG. 3*c* shows that all non-bonded pigments, and in this embodiment also melamine formaldehyde particles 13, have been removed. FIG. 3*d* shows a binder printing station comprising a scattering unit 27, a digital coating unit 36, a UV oven 23 and a powder removal system based 28 on an air stream and vacuum.

The first and the second principles may be combined. A binder pattern may be applied prior and after the application of the pigment mix and this may be used to create a solid print with a larger vertical extension and higher wear resistance.

Figure 4A:
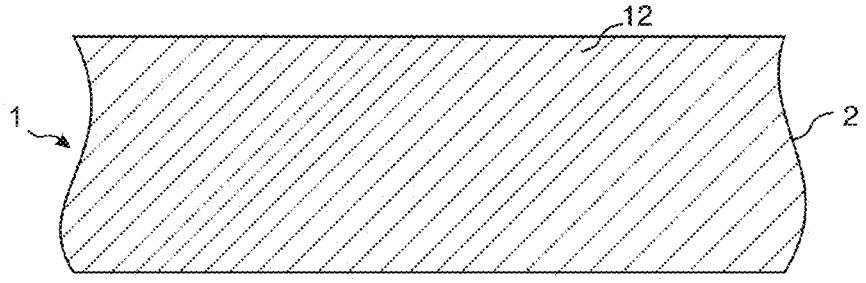
FIGS. 4*a-d* illustrate a third aspect of the invention.
Figure 4B:
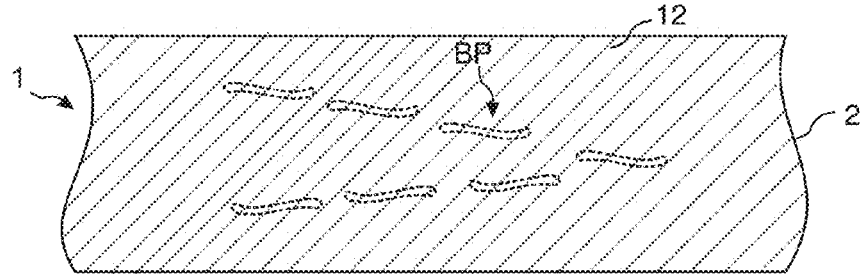
Figure 4C:
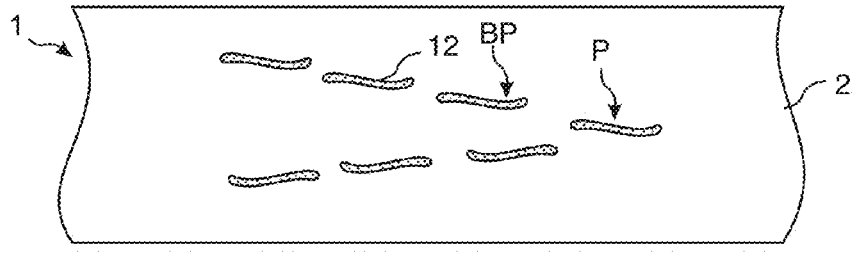

FIGS. 4*a*-4*c* show an embodiment of the invention, which is based on a third principle where the pigments 12 in a first step are scattered on a surface 2 and a binder pattern BP or image is thereafter formed digitally by a laser beam 29 that melts or cures a binder that may be mixed with the pigments 12 or included in the surface 2. A digitally created print P is obtained when the non-bonded pigments are removed.

Figure 4D:
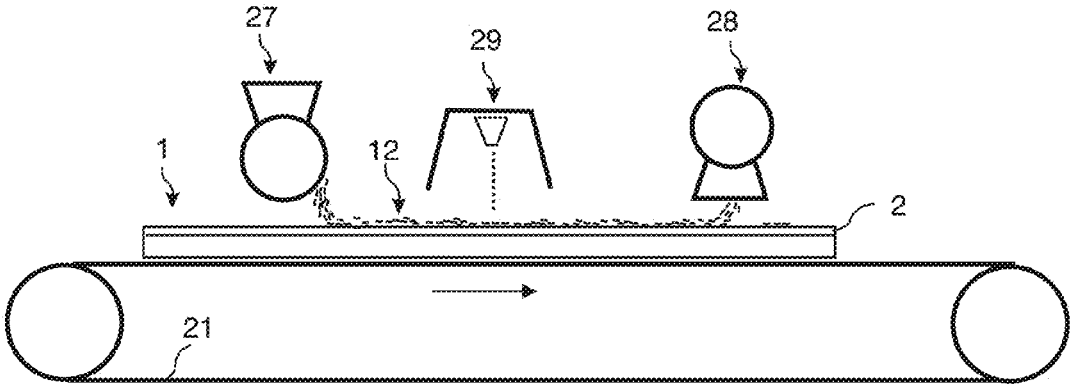

FIG. 4*d* shows a binder printing station comprising a scattering unit 27, a laser 29, and a powder removal system 28 based on an air stream and vacuum. The laser may be replaced with heating lamps that may be used to create images that comprise rather large areas of the same colour as in some stone designs. Even a conventional laser system based on the above described impact method may be used to apply an digital print partly or completely on a floor panel or in combination with the above described binder printing methods.

All the above-described principles may be partly or completely combined and a production line may comprise several digital binder printing station according to the first, second or third principles.

Figure 5A:
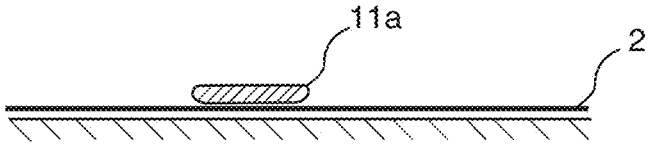
FIGS. 5*a-h* illustrate digital application of pigments according to the first aspect of the invention.
Figure 5B:
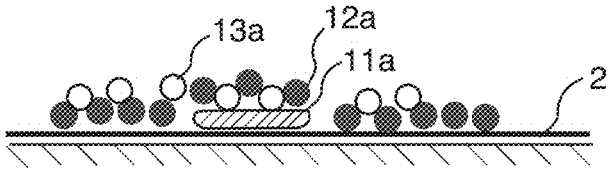
Figure 5C:
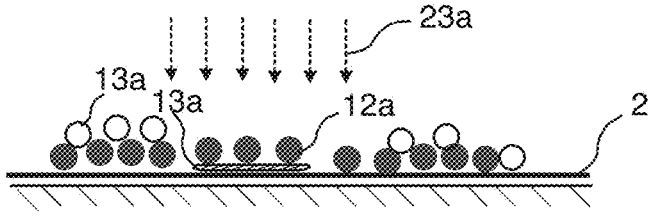
Figure 5D:
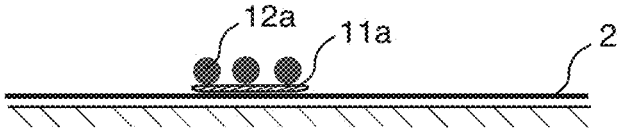
Figure 5E:
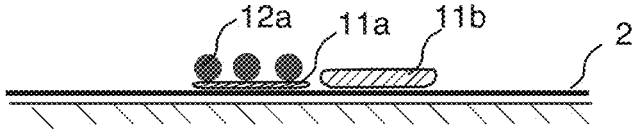
Figure 5F:
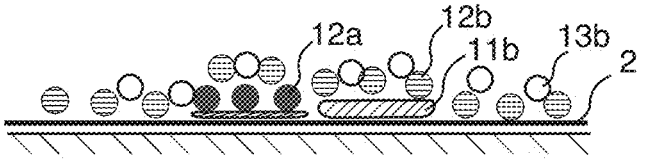
Figure 5G:
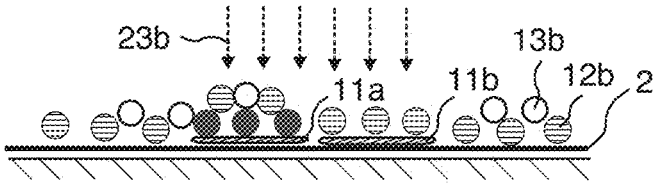
Figure 5H:
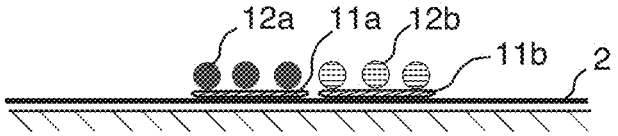

FIGS. 5*a*-5*h* show application of two different colours according to the first principle. A first binder 11*a* that in this embodiment is essentially water is applied by a digital Piezo head on a surface 2 that may be a stabilized powder layer or a paper as shown in FIG. 5*a*. A first powder layer comprising colour pigments 12*a* and melamine formaldehyde particles 13*a* is applied on the surface 2 and on the binder 11*a*. Melamine formaldehyde particles 13*a* that are in contact with the wet water drops will melt. A first UV oven 23*a* dries the wet melamine formaldehyde and bonds the pigments to the surface as shown in FIG. 5*c* and the non-bonded melamine formaldehyde and pigment particles are removed such that a pigment image 12*a* that corresponds to the applied binder 11*a* is obtained. FIGS. 5*e*-5*h* show that the same application may be repeated with another pigment colour 12*b* mixed with melamine formaldehyde particles 13*b* and a new binder 11*b* such that a two colour image is obtained with two types of colour pigments 12*a*, 12*b* as shown in FIG. 5*h*.

Figure 6A:
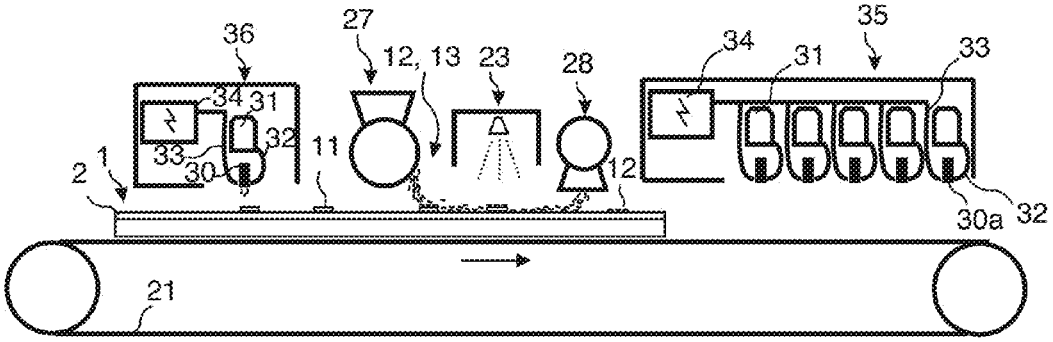
FIGS. 6*a-c* illustrate embodiments of the invention.

FIG. 6*a* shows an embodiment where the digital binder printing equipment comprising a digital coating unit 36, a scattering unit 27, UV curing unit 23, and a powder removal vacuum system 28, is combined with conventional ink jet printer 35. The binder printing method may use this combination to create the major part of a digital image while some parts of the final print may be created by the ink jet printer. This may reduce the ink cost considerably since, for example, the cost effective binder printing method, where no pigments have to be handled by the digital coating head, may apply, for example, 90% of the pigments which are needed to create a fully printed décor or pattern.

Figure 6B:
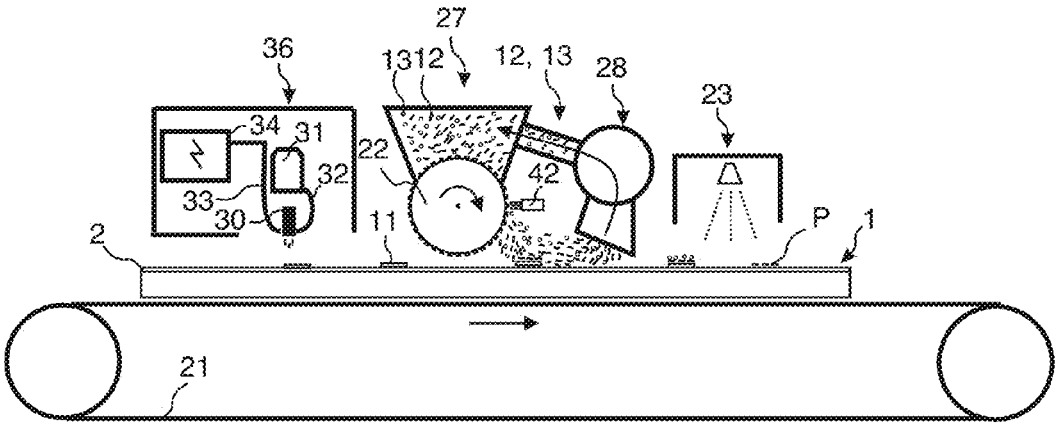

FIG. 6*b* shows a binder printing equipment where pigments 12 and melamine formaldehyde powder 13 are applied by a scattering unit 27 comprising preferably an embossed roller 22 and an oscillating brush 42. The non-bonded pigments and melamine formaldehyde particles are removed by a powder removal system 28 that recycles the mix 12, 13 into the scattering unit 27. A pigment/melamine formaldehyde dust cloud may be created by airstreams and only the pigments and melamine formaldehyde powder that come into contact with the wet binder 11 will be bonded to the surface 2.

Figure 6C:
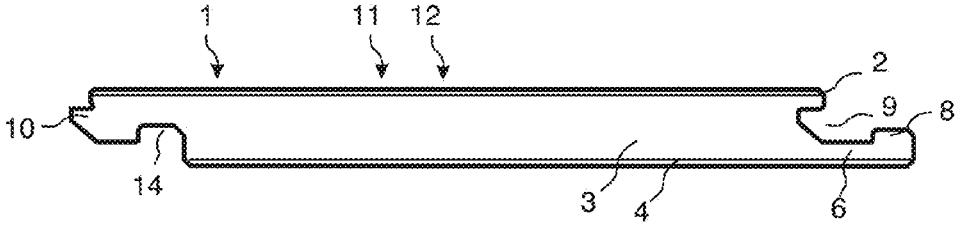

FIG. 6*c* shows that the method is especially suited to apply a digital binder print on a floor panel 1 with a paper based or powder based surface 2, a core 3, a balancing layer 4, and with a mechanical locking system comprising a strip 6, with a locking element 8 in one edge that cooperates with a locking groove 14 in an adjacent edge of another panel for horizontal locking of the adjacent edges and a tongue 10 in one edge that cooperated with a tongue groove 9 in another edge for vertical locking of the panels. Such floor panels have generally advanced wood or stone decors that require large amounts of different colour pigments and a decor that has to be positioned accurately in relation to embossed structures and the panel edges with the mechanical locking system.

In all embodiments, the surface of the building panel may comprise a thermosetting resin, for example, melamine formaldehyde resin. The building panel may be formed by applying heat and pressure, preferably after the digitally created image is formed by the bonded colour pigments. In one embodiment, the binder mixed with the dry colour pigments is cured simultaneously as the binder in the surface of the building panel, preferably by applying heat and pressure.

All the above-described methods may be partly or completely combined.

EXAMPLE

A powder mix of 300 g/m2 comprising wood fibres, melamine formaldehyde particles, brown colour pigments and aluminium oxide particles such as corundum was applied by scattering equipment on an 8 mm HDF core. The mix was sprayed with deionized water and dried by an UV oven such that a hard stabilized powder based surface with a brown basic colour was obtained. The panel with the stabilized powder surface was put on a conveyer and displaced under a digital Piezo coating head that applied drops of water on the stabilized surface and that printed a transparent wood grain pattern on the surface. The melamine formaldehyde under the transparent pattern melted when the digital coating Piezo head applied the water drops. Black pigments were in a second step scattered over the whole surface and the transparent pattern. The panel was thereafter displaced by a conveyor under an UV oven. The melamine formaldehyde in the transparent pattern was dried again and the pigments above the transparent pattern were bonded to the surface. The panel was thereafter displaced under a vacuum-sucking pipe where all non-bonded pigments and melamine formaldehyde particles were removed. A wood grain pattern comprising a brown base colour and a black wood grains structure was obtained. A protective layer comprising melamine formaldehyde and aluminium oxide particles was scattered over the entire surface. The layer was sprayed with water and dried under an UV oven. The panel with the print and the protective layer was thereafter pressed during 20 seconds under a temperature of 170 degrees C. in a 40 bars press and the powder-based surface with the grain structure and the protective layer was cured to a hard wear resistant surface with a high quality print.

Embodiments

1. A method of forming a digitally printed image (P) with colour pigments (12) on a surface (2) of a building panel (1), comprising the steps of:
   scattering dry colour pigments (12) on the surface (2),
   bonding a part of the dry colour pigments to the surface (2), and
   removing the non-bonded dry colour pigments from the surface such that a digitally created image (P) is formed by the bonded colour pigments (12).
2. The method as in embodiment 1, wherein the dry colour pigments (12) are bonded to a binder, the binder being separately applied on the surface (2) of the building panel (1).
3. The method as in embodiment 1, wherein the dry colour pigments (12) are mixed with a binder.
4. The method as in embodiment 2 or 3, wherein the binder comprises a thermosetting resin.
5. The method as in embodiment 2 or 3, wherein the binder comprises a thermoplastic resin.
6. The method as in any one of embodiments 2-5, wherein the binder is a powder.
7. The method as in any one of the preceding embodiments, wherein the surface (2) of the building panel (1) comprises a thermosetting resin, preferably melamine formaldehyde resin.
8. The method as in any one of the preceding embodiments, wherein the surface (2) of the building panel (1) is a paper layer or a foil.
9. The method as in any one of embodiments 1-7, wherein the surface (2) of the building panel (1) comprises a powder layer.
10. The method as in any one of the preceding embodiments, wherein the building panel is a floor panel (1).
11. The method as in embodiment 10, wherein the floor panel (1) comprises a mechanical locking system (6, 8, 9, 10, 14) for vertical and horizontal locking.
12. The method as in any one of the preceding embodiments, wherein the building panel is a wall panel or a furniture component (1).
13. The method as in any one of the preceding embodiments, wherein the non-bonded dry colour pigments (12) are removed by an airstream.
14. The method as in any one of the preceding embodiments, wherein the step of bonding said part of the dry colour pigments to the surface (2) comprises applying a liquid substance (11) by a digital coating head (30).
15. The method as in embodiment 14, wherein the liquid substance (11) is water based.
16. The method as in embodiment 14 or 15, the method further comprising exposing the liquid substance to UV light (23).
17. The method as in embodiment 16, wherein the liquid substance (11) is water based UV curable polyurethane.
18. The method as in any one of embodiments 14-15, wherein the liquid substance (11) comprises a thermosetting binder.
19. The method as in any one of the preceding embodiments 14-18, wherein the liquid substance is applied with a Piezo ink head.

20. The method as in any one of the preceding embodiments, wherein the step of bonding said part of the dry colour pigments to the surface (2) comprises applying a laser beam (29).
21. The method as in any one of the preceding embodiments, further comprising applying heat and pressure to the surface (2) of the building panel (1).
22. An equipment to provide a digital image (P) on a building panel (1), wherein the equipment comprises a digital coating head (30), a powder scattering unit (27), and a powder removal system (28) wherein:
    the digital coating head (30) is adapted to apply a liquid substance (11) on the panel, the powder scattering unit (27) is adapted to apply a powder layer comprising colour pigments (12) on the panel, wherein the liquid substance (11) is adapted to bond a part of the powder to the panel, and the powder removal unit (28) is adapted to remove the non-bonded powder from the panel (1).
23. An equipment as in embodiment 22, wherein the powder comprises a thermosetting resin.
24. An equipment as in embodiments 22 or 23, wherein the liquid substance (11) is water based.
25. An equipment as in any one of embodiments 22-24, wherein the liquid substance (11) is exposed to UV light.
26. An equipment as in any one of embodiments 22-25, wherein a surface layer (2) of the building panel (1) comprises a thermosetting resin, preferably melamine formaldehyde resin.
27. An equipment as in any one of embodiments 22-26, further comprising a pressing unit adapted to apply heat and pressure to the panel (1).

The invention claimed is:

1. A method of forming a digitally printed image with colour pigments on a surface of a building panel, comprising the steps of:
    scattering dry colour pigments on the surface;
    bonding a part of the dry colour pigments to the surface; and
    removing the non-bonded dry colour pigments from the surface such that a digitally created image is formed by the bonded colour pigments,
    wherein the dry colour pigments are bonded to a binder, the binder being separately applied on the surface of the building panel, wherein the binder is a liquid substance, and
    wherein the method further comprises applying heat and pressure to the surface of the building panel.

2. The method as claimed in claim 1, wherein the liquid substance is water based.

3. The method as claimed in claim 1, wherein the liquid substance is UV curable and wherein the method further comprises the step of exposing the liquid substance to UV light.

4. The method as claimed in claim 3, wherein the liquid substance is water based UV curable polyurethane.

5. The method as claimed in claim 1, wherein the binder comprises a thermosetting resin.

6. The method as claimed in claim 1, wherein the binder comprises a thermoplastic resin.

7. The method as claimed in claim 1, wherein the dry colour pigments are mixed with a binder.

8. The method as claimed in claim 1, wherein the binder is a powder.

9. The method as claimed in claim 1, wherein the surface of the building panel comprises a thermosetting resin.

10. The method as claimed in claim 1, wherein the surface of the building panel is a paper layer or a foil.

11. The method as claimed in claim 1, wherein the surface of the building panel comprises a powder layer.

12. The method as claimed in claim 1, wherein the building panel is a floor panel, a wall panel, or a furniture component.

13. The method as claimed in claim 1, wherein the building panel is a floor panel comprising a mechanical locking system for vertical and horizontal locking.

14. The method as claimed in claim 1, wherein the non-bonded dry colour pigments are removed by an air-stream.

15. The method as claimed in claim 1, wherein the step of bonding said part of the dry colour pigments to the surface comprises applying a liquid substance by a digital coating head.

16. The method as claimed in claim 15, wherein the liquid substance is applied with a Piezo ink head.

* * * * *